US008511765B1

(12) United States Patent
Chen et al.

(10) Patent No.: US 8,511,765 B1
(45) Date of Patent: Aug. 20, 2013

(54) TWO WAY TRAVEL DRAWER SLIDE

(75) Inventors: Kung-Cheng Chen, Taichung (TW); Lung-Chuan Huang, Taichung (TW)

(73) Assignee: E-Make Co., Ltd., Taichung (TW)

( * ) Notice: Subject to any disclaimer, the term of this patent is extended or adjusted under 35 U.S.C. 154(b) by 0 days.

(21) Appl. No.: 13/569,001

(22) Filed: Aug. 7, 2012

(51) Int. Cl.
*A47B 95/00* (2006.01)

(52) U.S. Cl.
USPC .... 312/333; 312/330.1; 312/286; 312/334.44

(58) Field of Classification Search
USPC ..... 312/333, 334.44–334.47, 286, 330.1
See application file for complete search history.

(56) References Cited

U.S. PATENT DOCUMENTS 5,577,821 A * 11/1996 Chu ..... 312/334.11
5,722,750 A * 3/1998 Chu ..... 312/334.11
6,220,683 B1 * 4/2001 Chu ..... 312/334.44
6,238,031 B1 * 5/2001 Weng ..... 312/333
6,257,683 B1 * 7/2001 Yang ..... 312/333
6,386,660 B1 * 5/2002 Yang ..... 312/334.46
6,402,275 B1 * 6/2002 Yang ..... 312/334.46
6,450,600 B1 * 9/2002 Chen et al. ..... 312/334.46
6,454,372 B1 * 9/2002 Yang ..... 312/334.13
6,715,851 B1 * 4/2004 Yang ..... 312/334.46
2002/0175605 A1 * 11/2002 Chen et al. ..... 312/333
2003/0034720 A1 * 2/2003 Milligan et al. ..... 312/334.44
2003/0042831 A1 * 3/2003 Le et al. ..... 312/334.44
2004/0070321 A1 * 4/2004 Yang ..... 312/334.46
2004/0207301 A1 * 10/2004 Chen et al. ..... 312/333
2005/0116595 A1 * 6/2005 Milligan ..... 312/334.46
2007/0108880 A1 * 5/2007 Lu ..... 312/334.11

* cited by examiner

*Primary Examiner* — Darnell Jayne
*Assistant Examiner* — Ryan A Doyle

(57) ABSTRACT

A two way three section slide drawer slide assembly for permitting a drawer to be selectively pulled out from opposite open ends of a compartment is provided with an elongated outer section secured to the compartment; an elongated intermediate section in the outer section; two elongated sliding members; an elongated inner section including a two-end open flat track, an intermediate opening, two positioning members at both ends of the intermediate opening respectively, and two tabs; an elongated bearing member; two stop units; and a flexible limit member including an intermediate flat portion and on either end of the flat portion, a latching member including an inclined surface at one end and an inclined extension at an intermediate portion, a ramp on the latching member, a slot abutted on the ramp, and a rectangular cut at the other end of the latching member.

6 Claims, 14 Drawing Sheets

TWO WAY TRAVEL DRAWER SLIDE

BACKGROUND OF THE INVENTION

1. Field of the Invention

The invention relates to drawer slides and more particularly to a drawer having two slide assemblies for allowing the drawer to selectively draw out (or pull back) from one of two opposite directions of a support body (e.g., desk, cabinet, service vehicle or the like).

2. Description of Related Art

A drawer is a box shaped container that fits into a piece of furniture in such a way that it can be drawn out horizontally to access its contents. However, typical drawers are designed to open or close from a front end of the drawer but not from either the front end or the rear end of the drawer.

In workshops, factories, service vehicles or the like two way or double pull drawers are necessary because opening or closing of the drawer from either the front end or the rear end thereof can facilitate work. Further, conventional drawers tend to malfunction. Furthermore, its components are complicated. In addition, its manufacturing cost is relatively high.

Thus, the need for providing a drawer having two slide assemblies for allowing the drawer to selectively draw out or pull back from one of two opposite directions of a support body (e.g., desk, cabinet, or the like) exists.

SUMMARY OF THE INVENTION

It is therefore one object of the invention to provide a two way travel three section slide drawer slide assembly for permitting a drawer to be selectively pulled out from opposite open ends of a compartment of a cabinet, comprising in combination an elongated outer section comprising a flat track threadedly secured to the compartment; an elongated intermediate section disposed in the outer section and comprising a flat track, two engaging members at both ends respectively, and two sets of two projecting stop units wherein one set of stop units is proximate to the engaging members at one end, and the other set of stop units is proximate to the engaging members at the other end; two elongated sliding members each slidably disposed either between upper edges of the outer section and the intermediate section or between lower edges of the outer section and the intermediate section wherein each sliding member is limited to travel in a distance between the stop units of the different sets; an elongated inner section releasably secured to the drawer and comprising a two-end open flat track, an intermediate opening, two positioning members at both ends of the intermediate opening respectively, and two lanced out tabs each spaced from the positioning member; an elongated bearing member disposed between the intermediate section and the inner section; two stop units releasably secured to the engaging members respectively, each stop unit comprising two bent projections on upper and lower edges respectively, a flange extending from the upper edge but opposing the adjacent projection, the flange including an inclined first surface at one end and an inclined second surface at the other end, and two horizontal sliding members each extending from one edge of the adjacent projection, each sliding member including a cavity at one end; and a flexible limit member comprising an intermediate flat portion adjacent to the intermediate opening, the limiting member further comprising, on either end of the flat portion, a latching member including an inclined surface at one end and an inclined extension at an intermediate portion, a ramp formed on the latching member, a slot abutted on the ramp, and a rectangular cut formed at the other end of the latching member distal the slot; wherein the inner section is secured to the limit member by putting the slots on the positioning members and putting the cuts on the tabs respectively; and wherein the drawer is prevented from pulling further either (i) from one end of the compartment when one inclined surface is stopped by the other inclined first surface in a complementary engagement or (ii) from the other end of the compartment when the other inclined surface is stopped by one inclined first surface in a complementary engagement.

The above and other objects, features and advantages of the invention will become apparent from the following detailed description taken with the accompanying drawings.

DETAILED DESCRIPTION OF THE INVENTION

Figure 1:
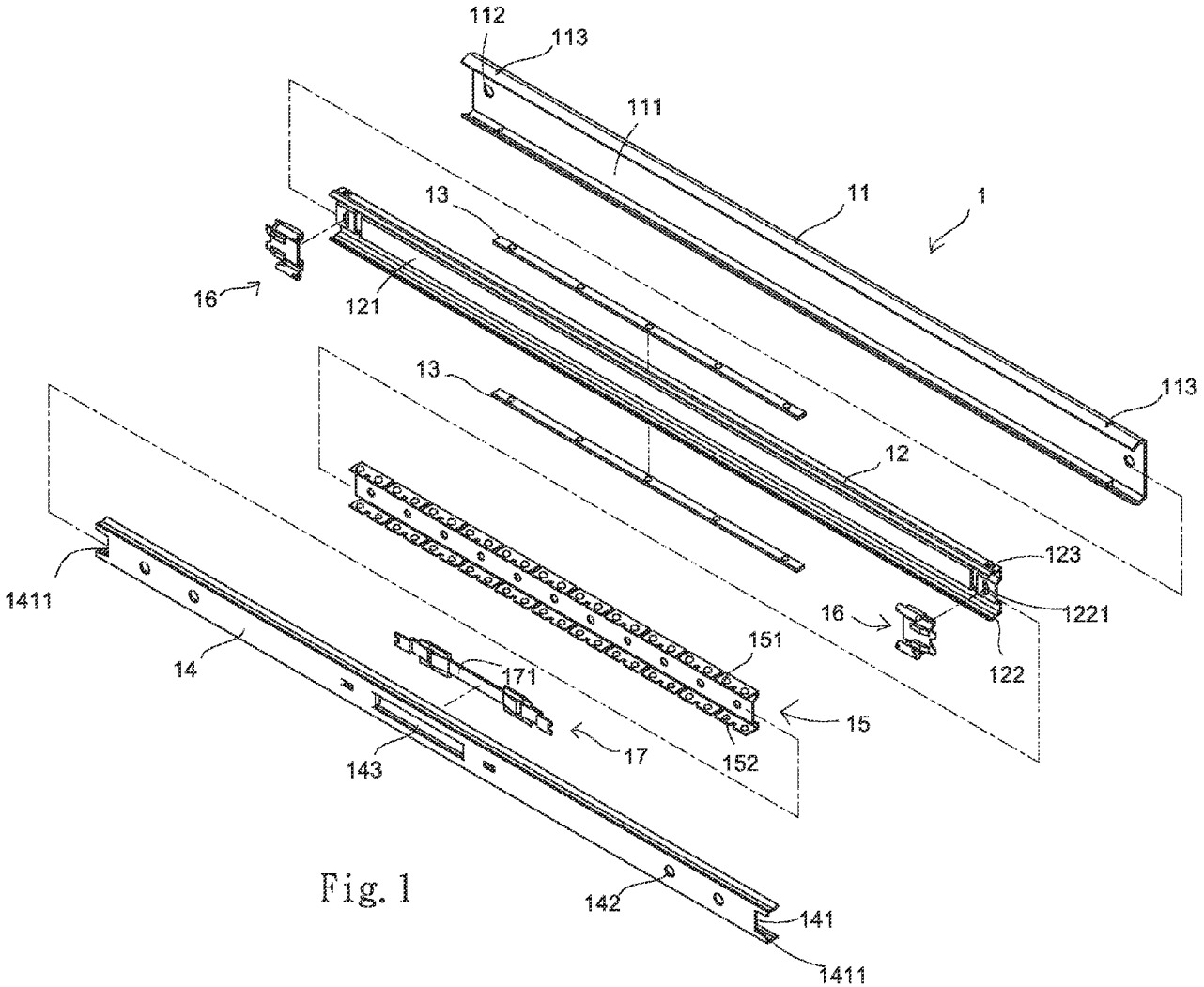
FIG. 1 is an exploded perspective view of a slide assembly for a drawer according to a first preferred embodiment of the invention.

Referring to FIGS. 1 to 9, a slide assembly 1 in accordance with a first preferred embodiment of the invention is shown. It is noted that identical assemblies 1 are mounted relative to opposite sides of a compartment 21 of a cabinet 2 and a drawer 22 so that a description of only one assembly 1 will suffice for present purposes.

The compartment 21 has a rear opening 211 and a front opening 212. On either side of the compartment 21 there is provided a positioning seat 213 including a curved well 214 on a top of the positioning seat 213. The drawer 22 has a space 221 defined therein and comprises, on either front end or rear end, a wall 222 and a handle 223 on a top edge of the wall 222. The drawer 22 further comprises two short, cylindrical pegs 224 formed on intermediate portions of both sides respectively. The peg 224 has about the same elevation as the well 214.

The slide assembly 1 comprises the following components as discussed in detail below. An elongated outer section 11 comprises a flat track 111, two threaded holes 112 proximate to both ends respectively, and two sets of two projecting stop elements 113 proximate the threaded holes 112 respectively, the two projecting stop elements 113 of either set being opposite and formed on one of two lengthwise curved edges of the track 111.

An elongated intermediate section 12 comprises a flat track 121, two engaging members 122 at both ends respectively, each engaging member 122 including a recess 1221, and two sets of two projecting stop members 123 proximate the engaging members 122 respectively, the two projecting stop members 123 of either set being opposite and formed on one of two lengthwise curved edges of the track 121.

Two elongated sliding members 13 are provided in which one sliding member 13 is retained between upper edges of the outer section 11 and the intermediate section 12 and the other sliding member 13 is retained between lower edges of the outer section 11 and the intermediate section 12. The provision of the sliding members 13 can reduce the friction of the outer section 11 and the intermediate section 12 when in motion as detailed later. Each sliding member 13 is limited to travel in a distance between the stop elements 113 of the same edge (i.e., between the stop members 123 of the same edge).

An elongated inner section 14 comprises a flat track 141 having two open ends 1411, a rectangular opening 143 on an intermediate portion, two positioning members 144 at both ends of the opening 143 respectively, two lanced out tabs 145 each spaced from the positioning member 144 by a short distance, and two sets of a plurality of threaded holes 142 in which each set of threaded holes 142 are disposed between the open end 1411 and the tab 145. More precisely, each set of threaded holes 142 are disposed proximate to the open end 1411. The track 141 has two about 90-degree bent edges. An elongated bearing member 15 comprises a plurality of first balls 151 on an upper bent edge and a plurality of second balls 152 on a lower bent edge.

Figure 2:
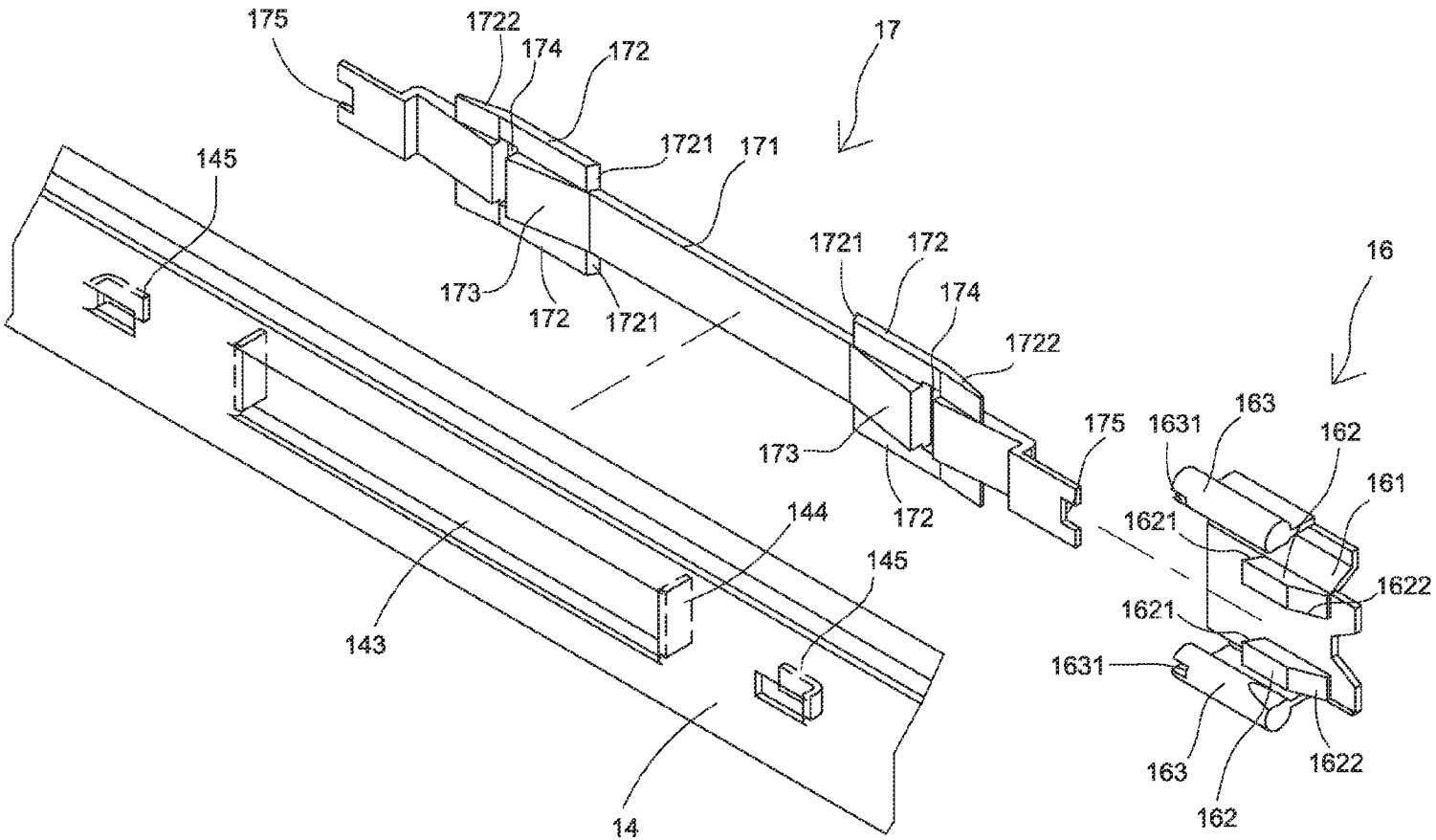
FIG. 2 is a perspective view of the limit member, the stop unit, and an intermediate portion of the inner section.

As shown in FIG. 2 specifically, two stop units 16 each comprise two bent projections 161 on upper and lower edges respectively; two flanges 162 extending from the upper and lower edges respectively but opposite to the adjacent projection 161, each flange 162 including an inclined first surface 1621 at one end and an inclined second surface 1622 at the other end; and two horizontal sliding members 163 each extending from one edge of the adjacent projection 161, each sliding member 163 including a cavity 1631 at one end.

A flexible limit member 17 comprises an intermediate flat portion 171 substantially disposed besides the opening 143. The limit member 17 further comprises, on either end of the flat portion 171, a latching member 172 including an inclined surface 1721 at one end and an inclined extension 1722 at an intermediate portion; a ramp 173 formed on the latching member 172; a slot 174 abutted on the ramp 173; and a rectangular cut 175 formed at the other end of the latching member 172 distal the slot 174.

The outer section 11 is secured to the side of the compartment 21 above positioning seat 213 by driving threaded fasteners through the threaded holes 112 into the side of the compartment 21. The inner section 14 is secured to the side of the drawer 22 by driving threaded fasteners through the threaded holes 142 into the side of the drawer 22. Also, the inner section 14 is secured to the limit member 17 by putting the slots 174 on the positioning members 144 and putting the cuts 175 on the tabs 145 respectively by snapping (i.e., friction fit).

The intermediate section 12 is disposed in the outer section 11. One sliding member 13 is retained by and between upper edges of the outer section 11 and the intermediate section 12 and the other sliding member 13 is retained by and between lower edges of the outer section 11 and the intermediate section 12 so as to reduce friction between the outer section 11 and the intermediate section 12. The bearing member 15 is disposed in a space defined by both the intermediate section 12 and the inner section 14. The projection 161 is retained in the recess 1221 in friction fit. The peg 224 is rested upon the well 214 when the drawer 22 is retracted into a closed position (see FIG. 7).

Figure 3:
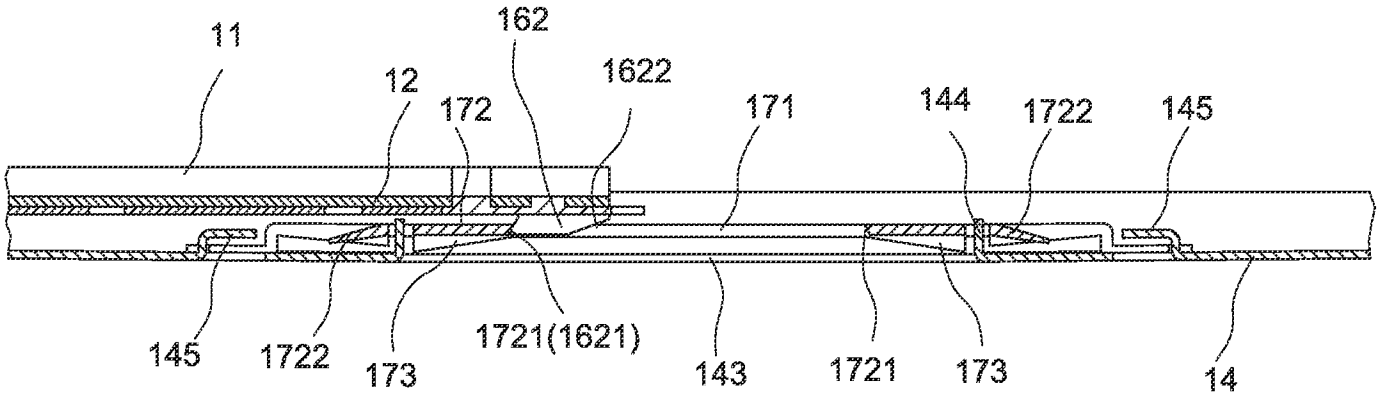
FIG. 3 is a side elevation in part section of the assembled slide assembly, the slide assembly being fully pulled from the front end.
Figure 8:
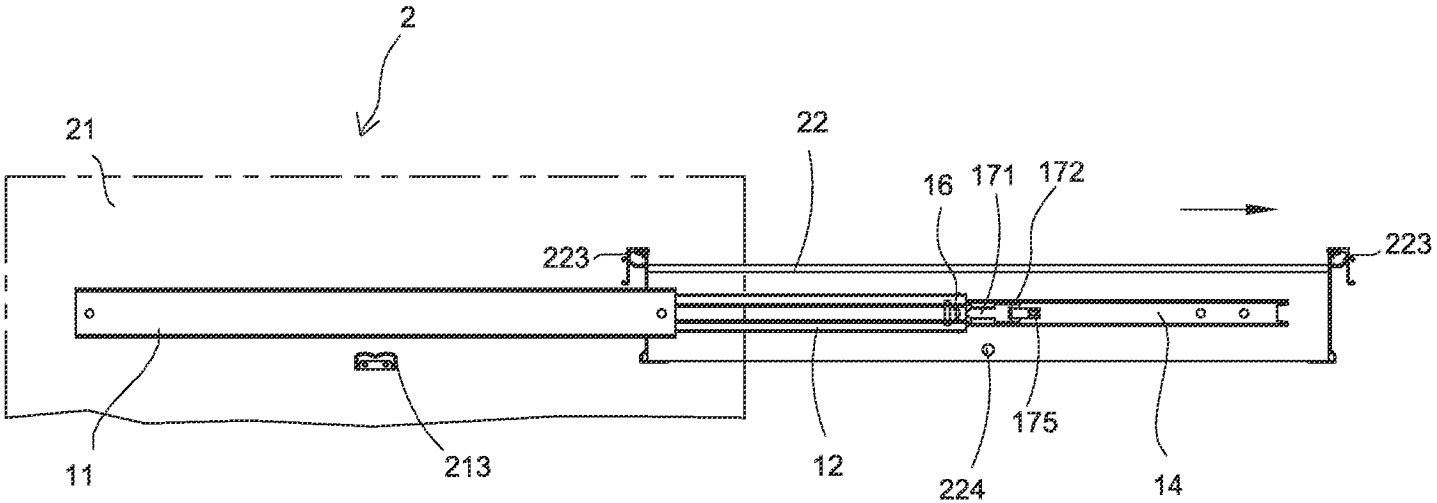
FIG. 8 is a view similar to FIG. 7 showing the drawer being fully open by pulling from the front end.

As shown in FIGS. 3 and 8, the drawer 22 is pulled rightward (i.e., the front end) to its extent (i.e., fully pulled) with the left inclined surface 1721 being stopped by the inclined first surface 1621 in a complementary engagement. Thus, a further rightward movement of the drawer 22 is prohibited.

Figure 4:
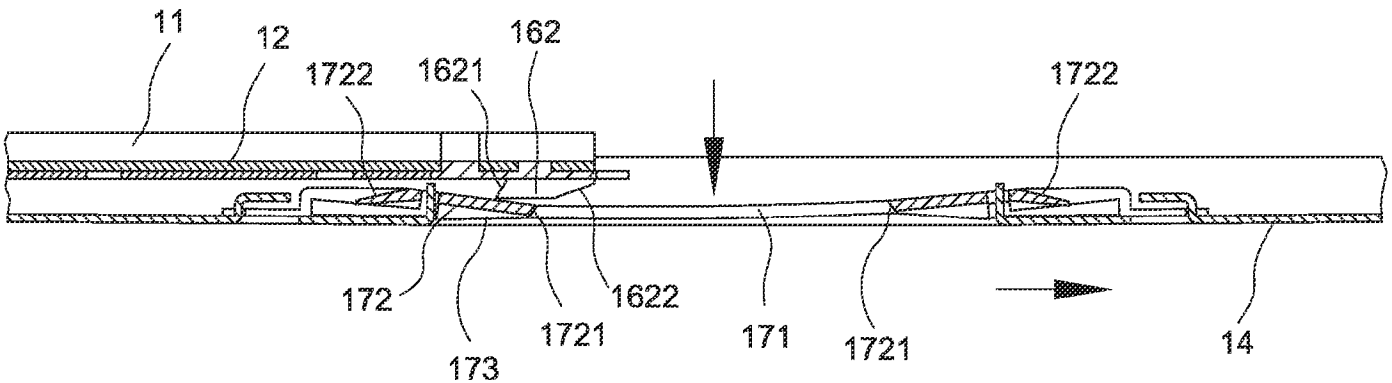
FIG. 4 is a view similar to FIG. 3 showing an immediate flat portion of the limit member being pressed for disengaging the limit member from the stop unit.

As shown in FIG. 4, as a continuation of FIG. 3, a user may press the limit member 17 transversely to disengage the left inclined surface 1721 from the inclined first surface 1621 and next pull the inner section 14 forward.

Figure 5:
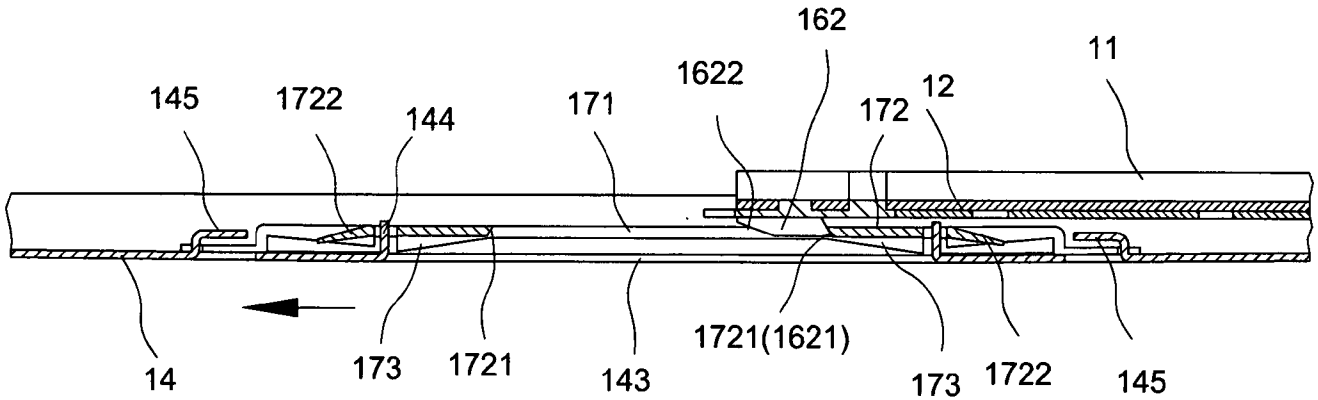
FIG. 5 is a view similar to FIG. 3 showing the slide assembly being pulled from the rear end.
Figure 6:
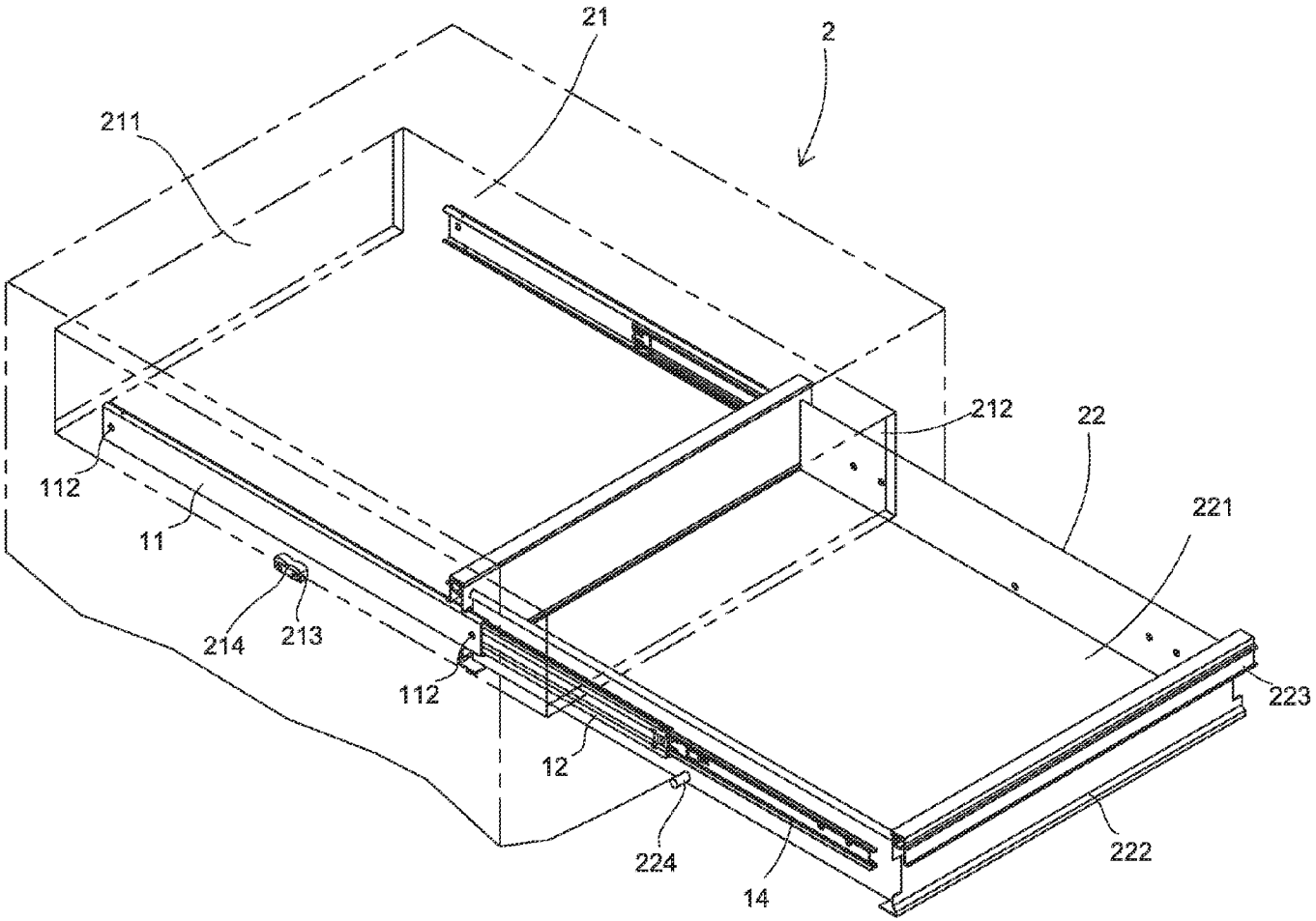
FIG. 6 is a perspective view of a cabinet and a drawer thereof being open to its maximum extent from the front end.
Figure 7:
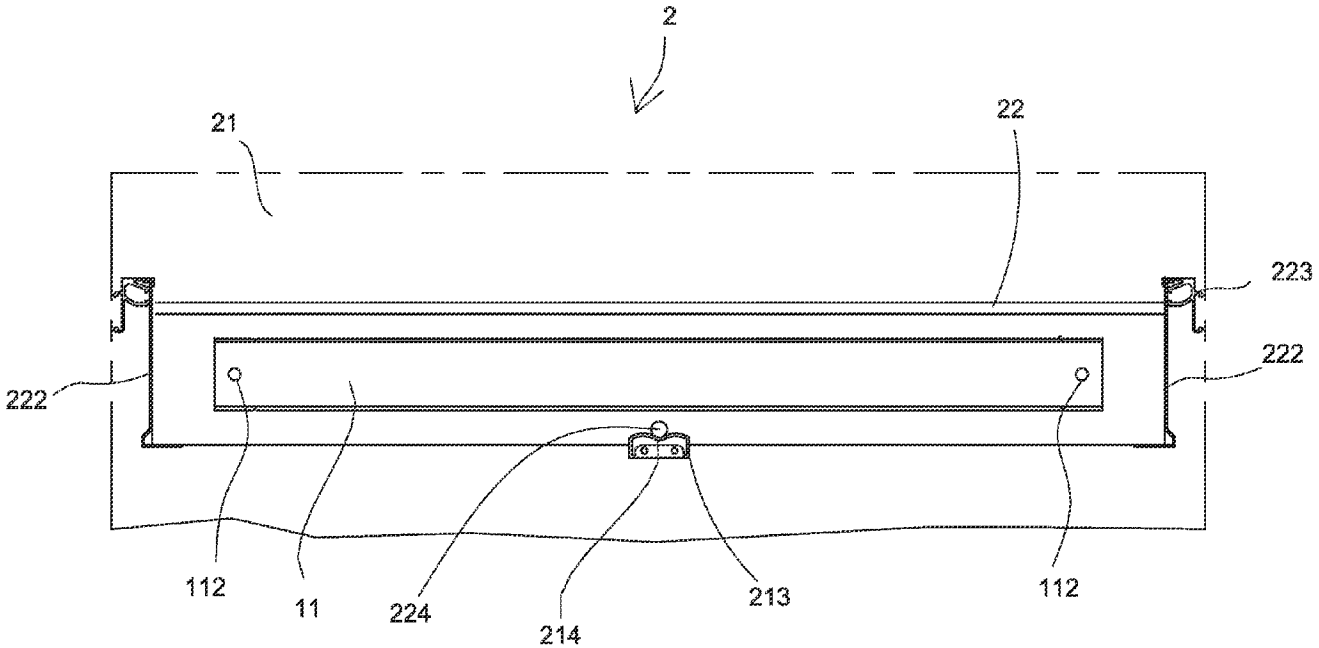
FIG. 7 is a side elevation of the cabinet with the drawer being retracted in a closed position.
Figure 9:
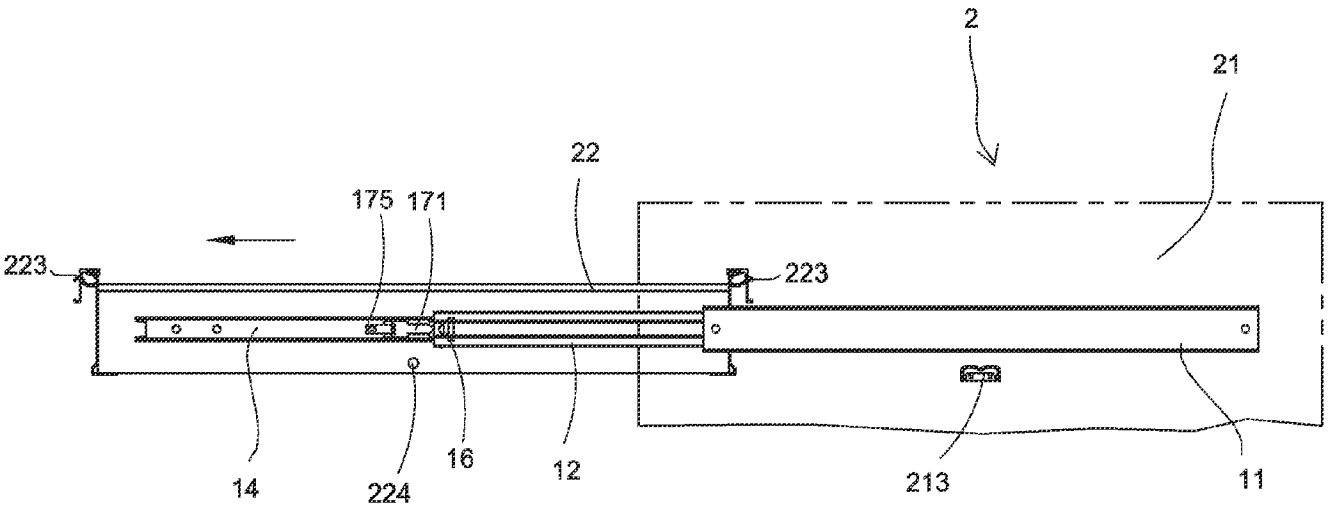
FIG. 9 is a view similar to FIG. 7 showing the drawer being fully open by pulling from the rear end.
Figure 10:
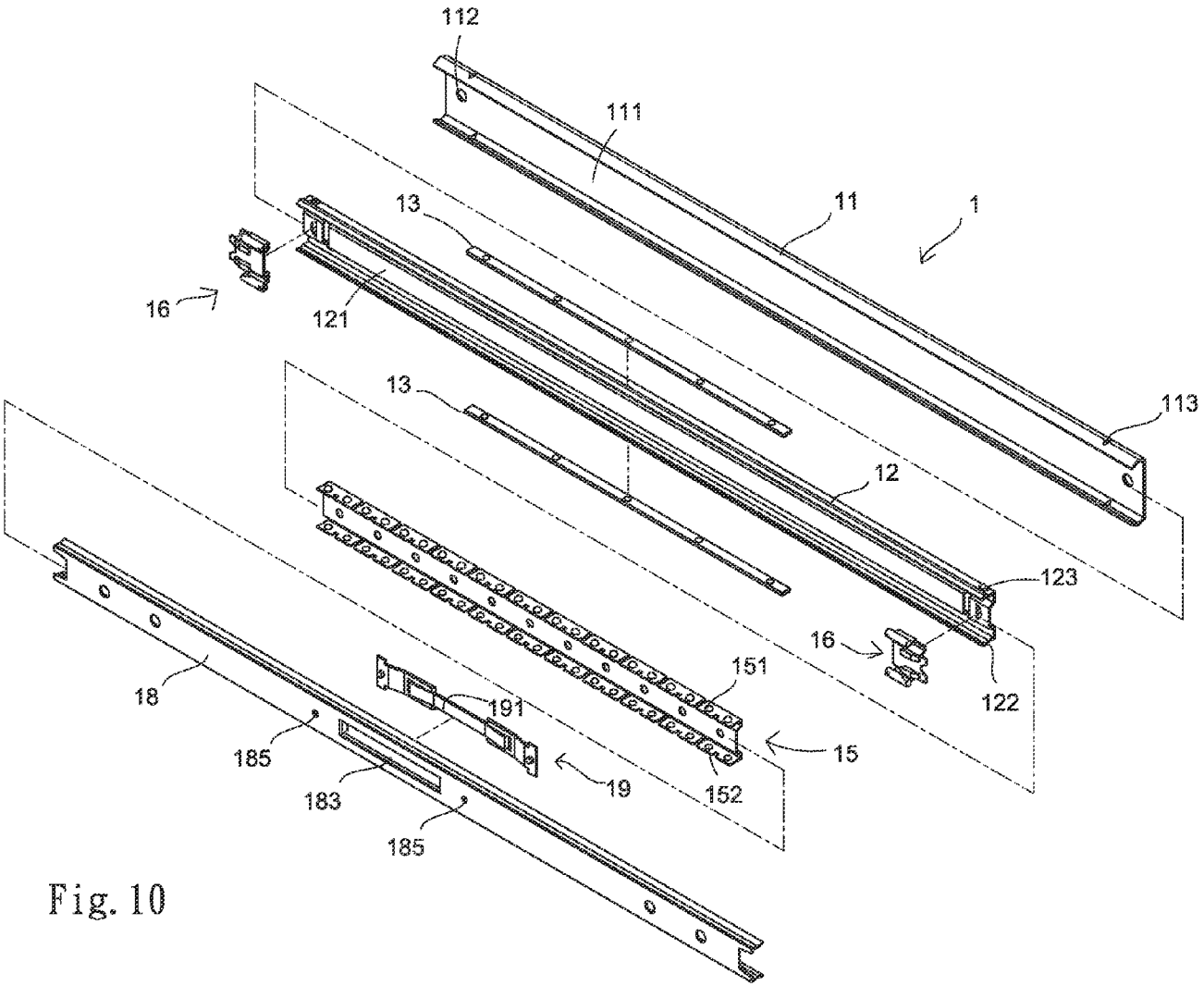
FIG. 10 is an exploded perspective view of a slide assembly for a drawer according to a second preferred embodiment of the invention.
Figure 11:
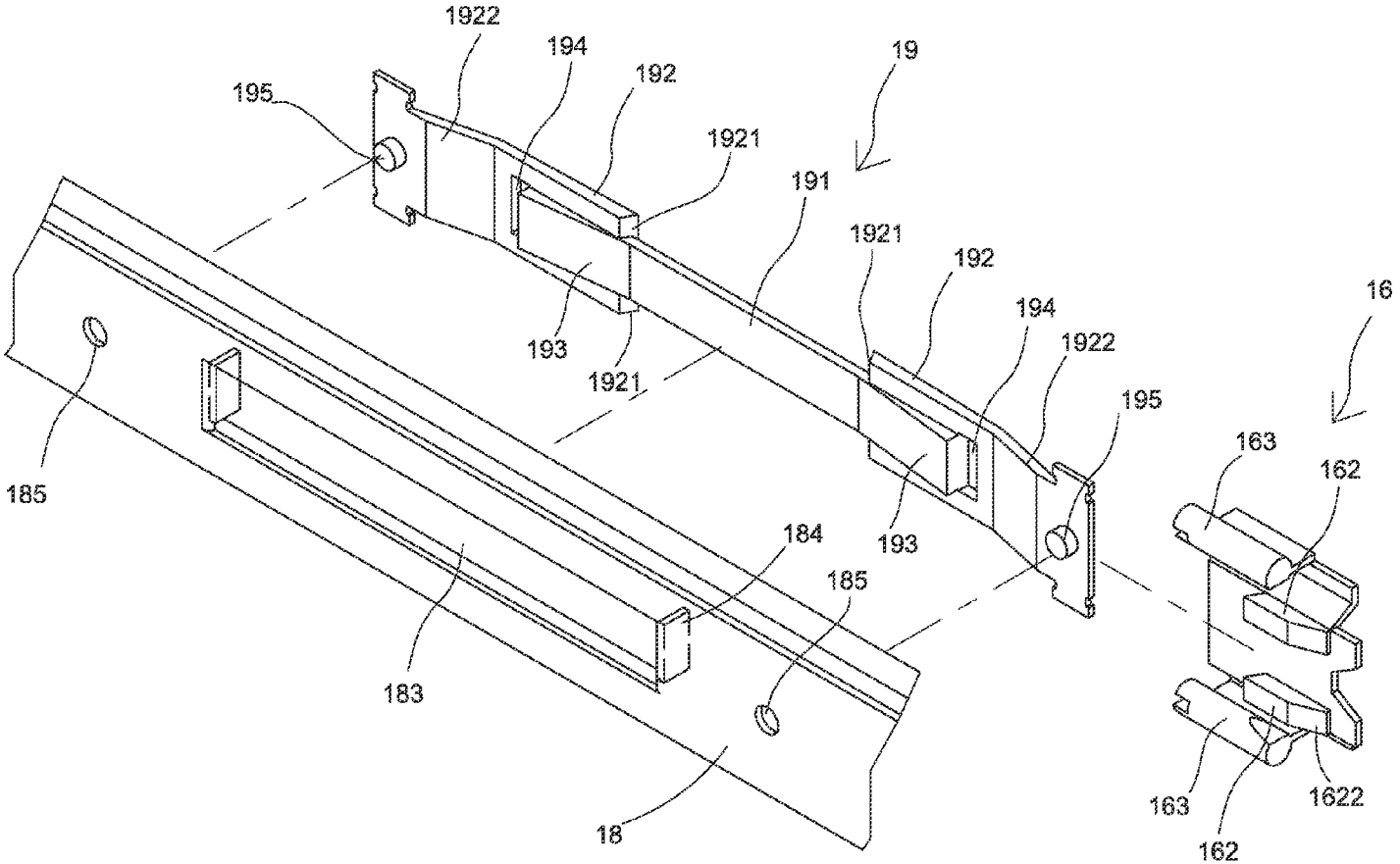
FIG. 11 is a perspective view of the limit member, the stop unit, and an intermediate portion of the inner section of FIG. 10.
Figure 12:
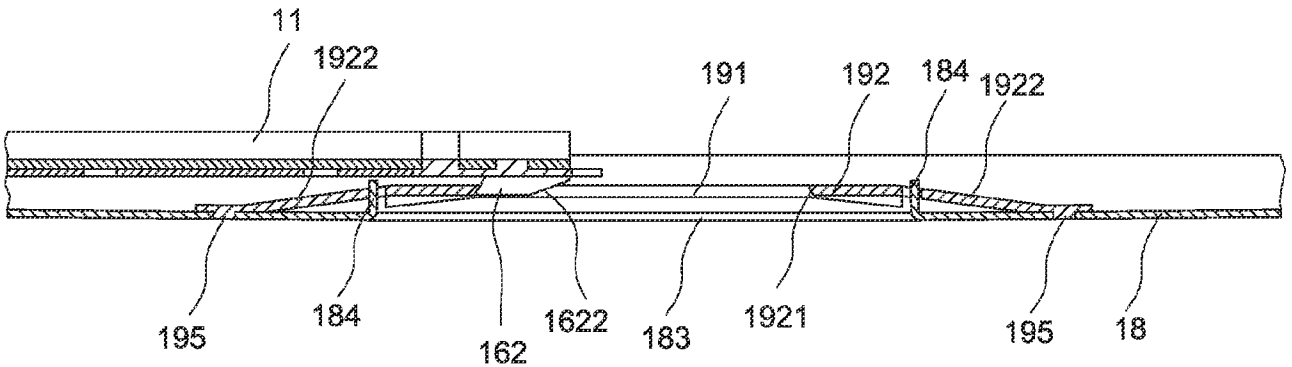
FIG. 12 is a side elevation in part section of the assembled slide assembly, the slide assembly being fully pulled from the front end.
Figure 13:
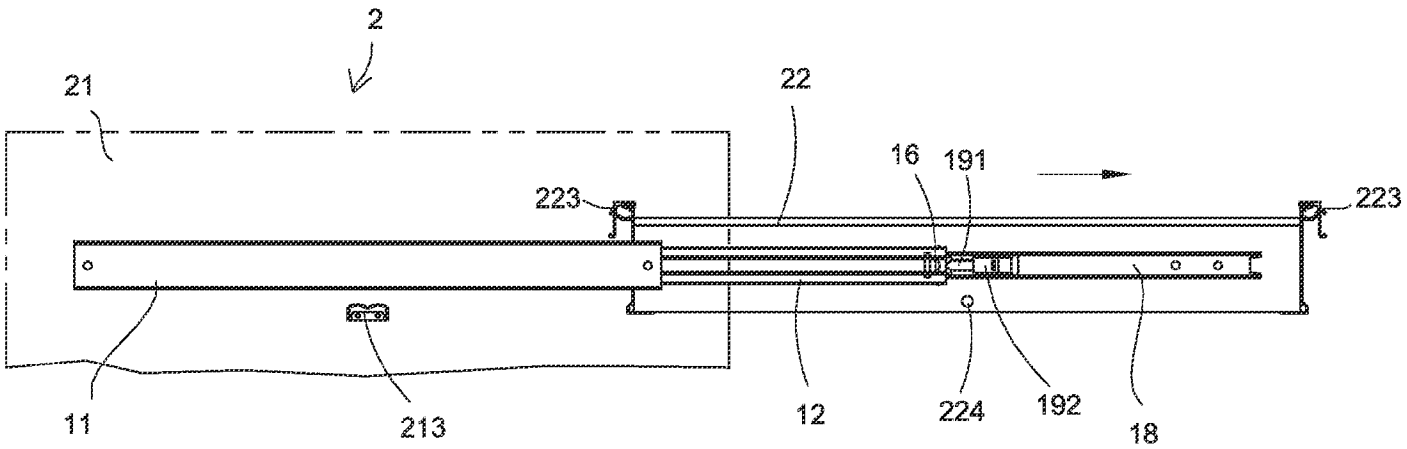
FIG. 13 is a side elevation of the cabinet showing the drawer being fully open by pulling from the front end.
Figure 14:
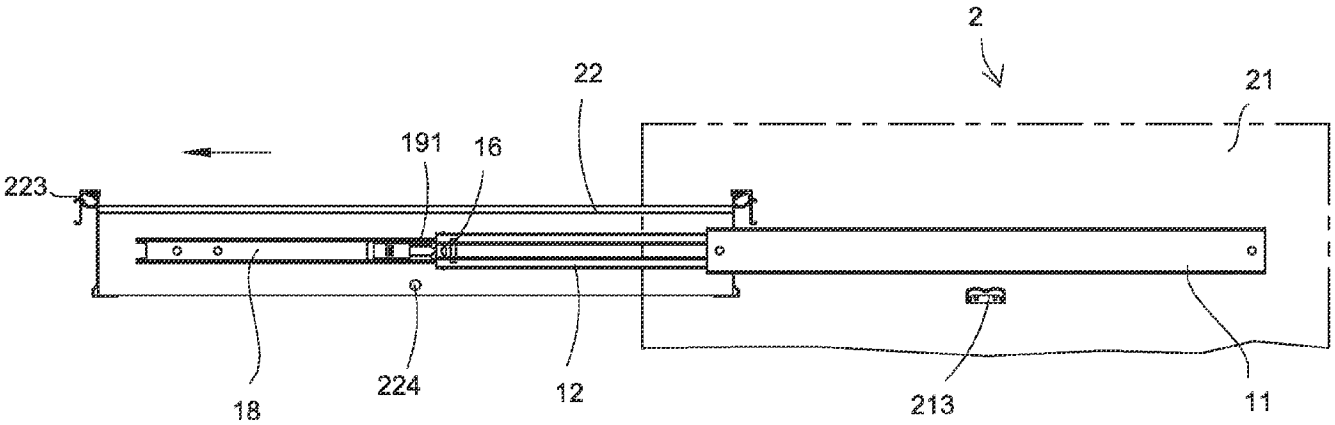
FIG. 14 is a view similar to FIG. 13 showing the drawer being fully open by pulling from the rear end.

As shown in FIGS. 5 and 9, the drawer 22 is pulled leftward (i.e., the rear end) with the right inclined surface 1721 riding on the inclined second surface 1622.

In view of the description of above three paragraphs, it is understood that the drawer 22 can move forward or rearward in a distance between the left inclined surface 1721 and the right inclined surface 1721 (i.e., being implemented as a two way drawer slide).

An opening operation of the drawer 22 from a front end of the cabinet 2 will be further described in detail below by referring to FIG. 8. As shown, a user may hold the handle 223 to pull the drawer 22 out of the compartment 21. And in turn, the peg 224 disengages from the well 214 and the inner section 14 slides about the intermediate section 12 by riding over the bearing member 15. In a first stage, the intermediate section 12 is concealed in the compartment 21 until an inner end of the inner section 14 is stopped by the stop unit 16. In an intermediate second stage, both the inner section 14 and the intermediate section 12 move rightward as indicated by arrow. The pulling will be stopped when the left inclined surface 1721 contacts the right inclined first surface 1621 in a complementary engagement. Thus, a further rightward movement of the drawer 22 is prohibited.

As shown in FIG. 9, an opening operation of the drawer 22 from a rear end of the cabinet 2 will be described in detail below. As shown, a user may hold the handle 223 to pull the drawer 22 out of the compartment 21. And in turn, the peg 224 disengages from the well 214 and the inner section 14 slides about the intermediate section 12 by riding over the bearing member 15. In a first stage, the intermediate section 12 is concealed in the compartment 21 until an outer end of the inner section 14 is stopped by the stop unit 16. In an intermediate second stage, both the inner section 14 and the intermediate section 12 move leftward as indicated by arrow. The pulling will be stopped when the right inclined surface 1721 contacts the left inclined first surface 1621 in a complementary engagement. Thus, a further leftward movement of the drawer 22 is prohibited.

Referring to FIGS. 10 to 14, a slide assembly 1 in accordance with a second preferred embodiment of the invention is shown. The characteristics of the second preferred embodiment are substantially the same as that of the first preferred embodiment except the following:

An elongated inner section 18 comprises a rectangular opening 183 on an intermediate portion, two positioning members 184 at both ends of the opening 183 respectively, and two through holes 185, as replacements of the tabs, each spaced from the positioning member 184 by a short distance.

A flexible limit member 19 comprises an intermediate flat portion 191 substantially disposed besides the opening 183. The limit member 19 further comprises, on either end of the flat portion 191; a latching member 192 including an inclined surface 1921 at one end and an inclined extension 1922 at an intermediate portion; a ramp 193 formed on the latching member 192; a slot 194 abutted on the ramp 193; and a short cylinder 195 formed proximate the other end of the latching member 192 distal the slot 194. The cylinders 195 are adapted to insert into the through holes 185 in a friction fit and the positioning members 184 are adapted to insert into the slots 194 in a friction fit for fastening the limit member 19 and the inner section 18 together.

Similarly to the first preferred embodiment of the invention, the drawer 22 can move forward or rearward in a distance between the left inclined surface 1921 and the right inclined surface 1921 (i.e., being implemented as a two way drawer slide).

It is envisaged by the invention that the drawer 22 is free to move in either direction.

While the invention has been described in terms of preferred embodiments, those skilled in the art will recognize that the invention can be practiced with modifications within the spirit and scope of the appended claims.

What is claimed is:

1. A two way travel three section slide drawer slide assembly permitting a drawer to be selectively pulled out from opposite open ends of a compartment of a cabinet, comprising in combination:

an elongated outer section comprising a flat track threadedly secured to the compartment, and two sets of two projecting stop elements wherein the stop elements of either set are opposite and formed on one of two lengthwise curved edges of the track of the outer section;

an elongated intermediate section disposed in the outer section and comprising a flat track, two engaging members at both ends respectively, and two sets of two projecting stop members wherein one set of stop members is proximate to the engaging members at one end, and the other set of stop members is proximate to the engaging members at the other end;

two elongated sliding members each slidably disposed either between upper edges of the outer section and the intermediate section or between lower edges of the outer section and the intermediate section wherein each sliding member is limited to travel in a distance between the stop members of one set and the stop members of the other set;

an elongated inner section releasably secured to the drawer and comprising a two-end open flat track, an intermediate opening, two positioning members at both ends of the intermediate opening respectively, and two lanced out tabs each spaced from the positioning member;

an elongated bearing member disposed between the intermediate section and the inner section;

two stop units releasably secured to the engaging members respectively, each stop unit comprising two bent projections on upper and lower edges respectively, two flanges extending from the upper and lower edges respectively but opposing the adjacent projection, each flange including an inclined first surface at one end and an inclined second surface at the other end, and two horizontal sliding members each extending from one edge of the adjacent projection, each sliding member including a cavity at one end; and a flexible limit member comprising an intermediate flat portion adjacent to the intermediate opening, the limiting member further comprising, on each end of the flat portion, a latching member including an inclined surface at one end and an inclined extension at an intermediate portion, a ramp formed on the latching member, a slot abutted on the ramp, and a rectangular cut formed at the other end of the latching member distal the slot;

wherein the inner section is secured to the limit member by putting the slots on the positioning members and putting the cuts on the tabs in friction fit respectively; and wherein the drawer is prevented from pulling further either (i) from one end of the compartment when one inclined surface is stopped by the other inclined first surface in a complementary engagement or (ii) from the other end of the compartment when the other inclined surface is stopped by one inclined first surface in a complementary engagement.

2. The two way travel three section slide drawer slide assembly of claim 1, wherein the compartment comprises a positioning seat on either side, the positioning seat having a top curved well; and wherein the drawer comprises a peg one either side, the peg being rested upon the well when the drawer is retracted into a closed position.

3. The two way travel three section slide drawer slide assembly of claim 1, wherein the cavity of one sliding member catches either end of an upper edge of the bearing member and the cavity of the other sliding member catches either end of a lower edge of the bearing member respectively so as to fasten the bearing member.

4. A two way travel three section slide drawer slide assembly permitting a drawer to be selectively pulled out from opposite open ends of a compartment of a cabinet, comprising in combination:

an elongated outer section comprising a flat track threadedly secured to the compartment, and two sets of two projecting stop elements wherein the stop elements of either set are opposite and formed on one of two lengthwise curved edges of the track of the outer section;

an elongated intermediate section disposed in the outer section and comprising a flat track, two engaging members at both ends respectively, and two sets of two projecting stop members wherein one set of stop members is proximate to the engaging members at one end, and the other set of stop members is proximate to the engaging members at the other end;

two elongated sliding members each slidably disposed either between upper edges of the outer section and the intermediate section or between lower edges of the outer section and the intermediate section wherein each sliding member is limited to travel in a distance between the stop members of one set and the stop members of the other set;

an elongated inner section releasably secured to the drawer and comprising a two-end open flat track, an intermediate opening, two positioning members at both ends of the intermediate opening respectively, and two through holes each spaced from the positioning member;

an elongated bearing member disposed between the intermediate section and the inner section;

two stop units releasably secured to the engaging members respectively, each stop unit comprising two bent projections on upper and lower edges respectively, two flanges extending from the upper and lower edges respectively but opposing the adjacent projection, each flange including an inclined first surface at one end and an inclined second surface at the other end, and two horizontal sliding members each extending from one edge of the adjacent projection, each sliding member including a cavity at one end; and a flexible limit member comprising an intermediate flat portion adjacent to the intermediate opening, the limiting member further comprising, on each end of the flat portion, a latching member including an inclined surface at one end and an inclined extension at an intermediate portion, a ramp formed on the latching member, a slot abutted on the ramp, and a cylinder formed at the other end of the latching member distal the slot;

wherein the inner section is secured to the limit member by putting the slots on the positioning members and inserting the cylinders into the through holes in friction fit respectively; and wherein the drawer is prevented from pulling further either (i) from one end of the compartment when one inclined surface is stopped by the other inclined first surface in a complementary engagement or (ii) from the other end of the compartment when the other inclined surface is stopped by one inclined first surface in a complementary engagement.

5. The two way travel three section slide drawer slide assembly of claim 4, wherein the compartment comprises a positioning seat on either side, the positioning seat having a top curved well; and wherein the drawer comprises a peg one either side, the peg being rested upon the well when the drawer is retracted into a closed position.

6. The two way travel three section slide drawer slide assembly of claim 4, wherein the cavity of one sliding member catches either end of an upper edge of the bearing member and the cavity of the other sliding member catches either end of a lower edge of the bearing member respectively so as to fasten the bearing member.

* * * * *